United States Patent [19]

Hoehn

[11] 4,195,995

[45] Apr. 1, 1980

[54] METHOD FOR PRODUCING FILM EXPOSED TO DIFFERENT IMAGES

[75] Inventor: Randall J. Hoehn, Pekin, Ill.

[73] Assignee: Caterpillar Tractor Co., Peoria, Ill.

[21] Appl. No.: 901,038

[22] Filed: Apr. 28, 1978

[51] Int. Cl.[2] ..... G03C 5/04; G03C 5/24; G03C 5/26

[52] U.S. Cl. ..... 430/142; 430/394; 430/494; 430/390; 430/401

[58] Field of Search ..... 96/41, 48, 42, 50, 63; 354/105, 110; 355/40, 77

[56] References Cited

U.S. PATENT DOCUMENTS

| | | | |
|---|---|---|---|
| 656,769 | 8/1900 | Hunter | 96/42 |
| 3,045,587 | 7/1962 | Schwertz | 355/3 R |
| 3,080,802 | 3/1963 | Friedel | 354/5 |
| 3,155,815 | 12/1963 | Friedel | 354/5 |
| 3,158,523 | 11/1964 | Morrow | 354/86 |
| 3,285,150 | 11/1966 | Wunderle | 354/105 |
| 3,717,975 | 2/1973 | Bloom | 96/41 |
| 3,935,011 | 1/1976 | Schindl | 96/41 |
| 3,959,803 | 5/1976 | Marvel | 354/105 |

*Primary Examiner*—Mary F. Kelley
*Attorney, Agent, or Firm*—William B. Heming

[57] ABSTRACT

A method produces a reproducible image on a film in a single machine. Steps include exposing the film to an image, passing the exposed film to a developing station and developing the film. An improved method controllably recovers the exposed film from the single machine without developing the film. The exposed film is subsequently exposed to a second different image in the single machine to form a composite exposed film. The composite exposed film is passed to the developing station and developed in the single machine to produce a composite image film for reproduction purposes.

1 Claim, 1 Drawing Figure

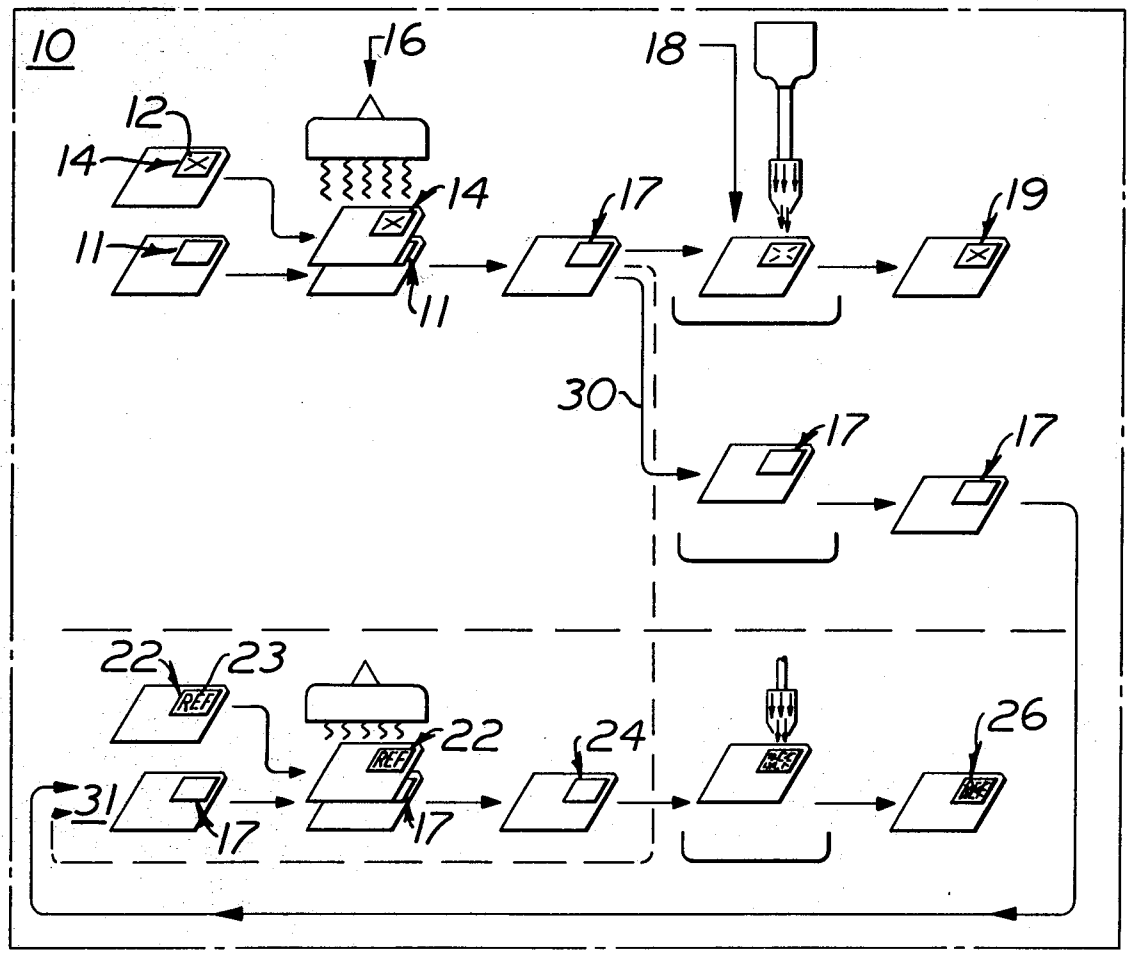
10
12
14
11
16
14
11
17
18
19
17
30
17
26
24
22
17
23
22
17
31

METHOD FOR PRODUCING FILM EXPOSED TO DIFFERENT IMAGES

BACKGROUND OF THE INVENTION

In the use of reproducible images on film, it is desirable to form a composite of reproducible images from master films in a single machine for supplying information in addition to that contained on one such reproducible image.

Commonly, master film images are produced from engineering drawing originals. The master film images are then used to produce copy film images.

For example, a diazo card to card copying machine exposes a blank copy film to the master film and automatically passes the exposed film through developing to produce a reproducible image on the copy film. The copy films are then used to reproduce on paper the information contained thereon. Subsequent additional information required on the paper reproduction heretofore necessitated the step of manually adding the information to the reproductions after production from the film image. The step is critical when information contained on the reproductions becomes outdated. Inadvertent failure to so mark outdated information can sometimes result in improper use of the information.

Therefore, it is desirable to provide a method in a single machine for exposing a film to different images to form a composite exposed film and to subsequently develop the exposed film in said machine.

SUMMARY OF THE INVENTION

According to the present invention, a method mechanically produces a reproducible image on a film. In a single machine, the steps include exposing the film to an image, passing the exposed film to a developing station and developing the exposed film. An improved method includes controllably recovering the exposed film from the single machine without developing the film. The exposed film is subsequently exposed to a second different image in said single machine to form a composite exposed film. In said single machine, the composite film is then passed to the developing station and developed to produce a composite image film for reproduction purposes.

BRIEF DESCRIPTION OF THE DRAWING

The drawing is a flow chart illustrating an improved method being used to produce a composite image film in a single machine.

DETAILED DESCRIPTION

Referring to the drawing, in a method for mechanically producing reproducible images on a film, a single machine 10 exposes a blank film 11 to a first image 12 on a first master film 14 at an exposing station 16. The exposed film 17 then passes to a developing station 18 and is developed. After the developing station, the film 19 is usable for reproducing on paper the image 12 contained thereon. The single machine 10 is a diazo card to card copying machine and is well known in the art for producing microfilm copies containing images for reproduction.

The exposed film 17 is controllably recoverable from the machine 10 without developing said film 17. The developing station 18 is deenergized and the exposed film 17 passes completely through the machine 10 without being developed. This is shown as an alternate route 30. The exposed film 17 can also be recovered from the machine 10 at a location on its pathway through the machine 10 to the developing station 18 (shown in broken lines).

After the exposed film 17 is recovered from the machine 10, said film 17 is again passed through the single machine 10, shown as a different route 31. The film 17 is subsequently exposed to a second different image 23 on another master film 22 and an exposed film 24 having a composite image is formed. The film 24 is then passed to the developing station 18 and developed. The final composite image film 26 is usable to reproduce the composite images. In this manner, the composite image film 26 provides additional information and substantially overcomes an inadequacy of information contained in only the single image film 12.

Other single machines may be used without departing from this invention. Other steps or stations may be included without departing from the invention.

Other aspects, objects and advantages of this invention can be obtained from a study of the drawings, the disclosure and the appended claims.

The embodiments of the invention in which an exclusive property or privilege is claimed are defined as follows:

1. In a method for mechanically producing a reproducible image on a film which includes exposing the film to a first image, passing the exposed film to a developing station and developing the film in a single machine, the improvement comprising:

blocking the function of the developing station;

passing the exposed film through said single machine and controllably recovering the exposed film from said single machine without developing said exposed film;

subsequently exposing said exposed film to a second different image in said single machine and forming a composite exposed film;

passing the composite exposed film to the developing station of said single machine; and developing said composite exposed film in said single machine.

* * * * *